US006048628A

United States Patent [19]

Hillmann et al.

[11] Patent Number: 6,048,628

[45] Date of Patent: Apr. 11, 2000

[54] MULTIPLE-PLATE STRUCTURE OF ZONAL DESIGN FOR A SHAPED PART

[75] Inventors: Jürgen Hillmann, Gifhorn; Klaus-Dieter Morsch, Braunschweig, both of Germany

[73] Assignee: Volkswagen AG, Wolfsburg, Germany

[21] Appl. No.: 09/018,741

[22] Filed: Feb. 4, 1998

[30] Foreign Application Priority Data

Feb. 8, 1997 [DE] Germany ..... 197 04 787

[51] Int. Cl.[7] ..... B32B 3/08; B32B 3/06; B23K 33/00; B21D 39/03

[52] U.S. Cl. ..... 428/594; 428/582; 428/614; 228/171

[58] Field of Search ..... 428/582, 594, 428/609, 614; 228/137, 171, 185

[56] References Cited

U.S. PATENT DOCUMENTS

| | | | |
|---|---|---|---|
| 1,446,274 | 2/1923 | Roberts | 428/609 |
| 1,773,068 | 8/1930 | Vienneau | 228/171 |
| 2,145,937 | 2/1939 | Lockwood | 428/609 |
| 5,505,365 | 4/1996 | Olsen | 228/171 |

FOREIGN PATENT DOCUMENTS

| | | | |
|---|---|---|---|
| 522262 | 7/1921 | France | 228/171 |
| 4307563 | 9/1993 | Germany . | |
| 52-44548 | 11/1977 | Japan | 228/171 |
| 60-148685 | 8/1985 | Japan | 228/171 |
| 8930 | of 1887 | United Kingdom | 428/582 |

*Primary Examiner*—John J. Zimmerman
*Attorney, Agent, or Firm*—Baker Botts L.L.P.

[57] ABSTRACT

A formed part having a multiple-plate structure of zonal design includes a base plate and a plurality of reinforcing plates fastened to the base plate. The multiple-plate structure is configured so that its strength is largely adapted to the load profile to be applied to the formed part and so that its cost of production is reduced. To this end, the thicknesses of the reinforcing plates vary as a function of the load structure to be applied to the formed part and the reinforcing plates engage each other in a positive locking manner so that the abutting edges are provided essentially with regularly arranged projections which are in mutual engagement.

8 Claims, 2 Drawing Sheets

MULTIPLE-PLATE STRUCTURE OF ZONAL DESIGN FOR A SHAPED PART

BACKGROUND OF INVENTION

This invention relates to multiple-plate structures of zonal design, such as a double-plate structure, for forming a part which may be a part of a vehicle or a vehicle body, in which the formed part is subjected to a shaping process, for example a deep-drawing, folding or stamping process.

It is conventional practice to design a plate-structure part intended for a part-shaping operation with a thickness which varies in zones according to the mechanical loads to which the zones of the resulting part will be subjected. It is also known to adapt local zones of such a plate-structure part, e.g. for hinge and shock-absorber receptacles, for attachment regions for doors and flaps and for attachment regions for beams or other load-bearing elements, with a thickness which varies in accordance with predeterminable load condition occurring during the use of the formed part in order to avoid unnecessary material input and to achieve a reduction in weight. Such varying thickness plate design also permits a reduction in the initial thickness of such a plate-structure part by using a thinner base plate. Larger plate thicknesses are accompanied by greater plate strength, in particular torsional rigidity, bending strength and also greater compressive and tensile strength.

In conventional tailored blanks, plate strips of different thickness are joined together for this purpose, for example a thinner plate strip may be arranged between thicker plate strips, in order to be subsequently formed together into a shaped part. There are limitations on the use of these tailored blanks with respect to the adaptation of the material thickness to the respective load profile of the formed part used in the vehicle, i.e. the formed part is also still reinforced in zones in which it does not need to be reinforced. There are, therefore, corresponding limits placed on the reduction in weight when using tailored blanks.

A deep-drawn or stamped plate-structure part having a partial double-plate part structure and a manufacturing method for this are described in German Offenlegungsschrift No. 43 07 563. This plate-structure part is formed in multilayers from a base plate and reinforcing plates arranged in zones on the base plate and is manufactured in such a way that the reinforcing plates are fastened at least partly to the base plate before the part is formed and are then undetachably connected to the base plate after the part is formed. The plate-structure part described in this document also is a so-called multiple-plate structure in which a first reinforcing plate is disposed on a base plate and a further reinforcing plate is disposed in a predetermined zone on the first reinforcing plate. The zonal arrangement of a plurality of further reinforcing plates on the first reinforcing plate is also possible.

Such a multiple-plate structure may also be formed as a unit. With a multiple-plate structure, it is now possible to largely adapt the thickness of the plate-structure part to the load profile to be applied to the formed part and to limit the spatial area of the reinforcing plates to a minimum and to reinforce the base plate only exactly where this is absolutely necessary. In principle, it is also possible in this case to combine different materials or different material qualities with one another, for example to use a reinforcing plate having a higher strength than the base plate at zones which are relevant in terms of strength or in the region of force-application points in order to obtain an optimum result not only with respect to the mechanical requirements but also with regard to appearance and cost. However, the method for manufacturing such a multiple-plate structure is complicated and the forming process can be problematic, since at least three plates each, lying one above the other and only partly fastened to one another, have to be shaped together.

SUMMARY OF THE INVENTION

Accordingly, it is an object of the present invention to provide a multiple plate structure of zonal design for a shaped part which overcomes disadvantages of the prior art.

Another object of the invention is to provide a shaped part having a multiple-plate structure of zonal design which is largely adapted in its thickness profile and strength profile to the load profile to which the shaped part may be subjected and in which the cost of production is reduced.

These and other objects of the invention are attained by providing a base plate and reinforcing plates on the base plate in zones subjected to greater loads, the reinforcing plates adjoining each other in a positive-locking manner so that a structure like a patchwork carpet is present. According to the invention, the thickness, the bending and membrane strength, and the number of reinforcing plates are determined as a function of the load structure to which the formed part will be subjected. The more differentiated the load structure is in a certain zone, the smaller and the more varied in thickness is the configuration of the reinforcing plates which are arranged in a positive-locking manner in that zone. The margins of the reinforcing plates facing each other are profiled in plan view and are provided with regularly arranged projections with which the adjacent reinforcing plates are in mutual engagement. Due to this profiling and the mutual penetration in the marginal zones between plates of different thickness or different strength, a moderate transition from one effective plate thickness to another or from one strength value to another is provided, so that, for example, the bending stress on the shaped part caused by an applied bending moment is altered in a linear or non-linear manner as a function of the thicknesses or the strengths of the two and reinforcing plates and the configuration of the profiling in the mutual engagement zone of the reinforcing plates.

The shaped part according to the invention can be adapted to the given load structure and the thickness of the base plate can be minimized as a function of this load structure. The plate-structure part to be formed can, therefore, be manufactured with reduced usage of material, a factor which is ultimately accompanied by a reduction in weight.

The reinforcing plates may be fastened at their margins to the base plate, for example by a weld produced with a high-energy beam, such as a laser beam, as an uninterrupted marginal weld by which the reinforcing plates in engagement with each other can be advantageously connected to the base plate by a single weld.

It is likewise advantageous to fasten each of the profile projections of the reinforcing plates to the base plate by a spot weld. As further fastening methods, any other possible joining method, such as clinching, punch riveting or even adhesive bonding, may of course be used, in which case the use of the particular joining method may also depend on the location of the formed part on the motor vehicle and the required visual appearance of the part.

The projections of the reinforcing plates may be provided with curved or linear flanks. They should preferably interengage in a positive locking manner in each configuration so that no graduated changes in thickness or strength occur.

The reinforcing plates may advantageously be made of different materials having different strengths in order to reduce thickness differences or remove them entirely.

In addition, it may be expedient to provide the plates to be connected to each other with an anti-corrosive coating on the connecting side.

BRIEF DESCRIPTION OF THE DRAWINGS

Further objects and advantages of the invention will be apparent from a reading of the following description in conjunction with the accompanied drawings, in which.

DESCRIPTION OF PREFERRED EMBODIMENTS

Figure 1:
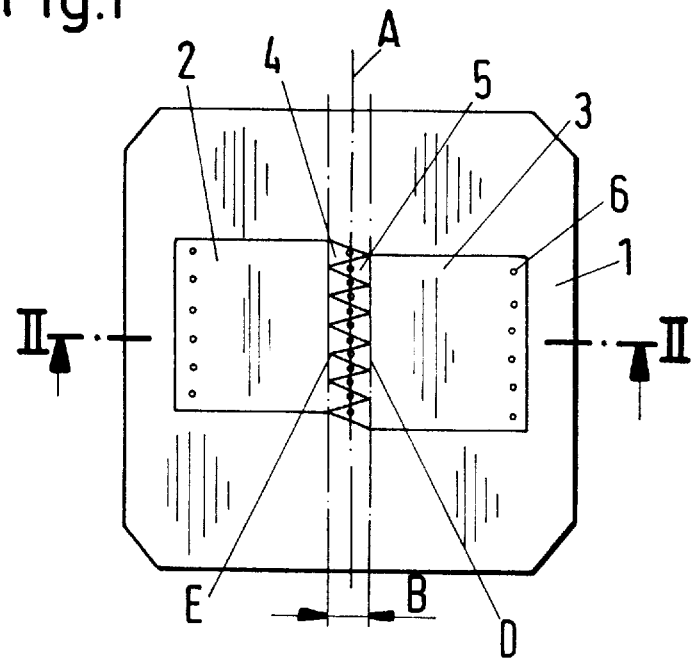
FIG. 1 is a plan view illustrating a representative embodiment of a formed part according to the invention having a double-plate structure.
Figure 2:
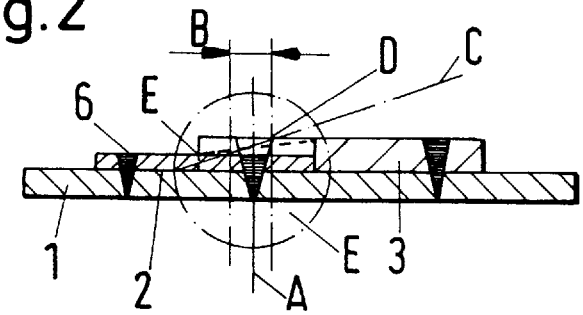
FIG. 2 is a cross-sectional view taken on the line II—II of FIG. 1 and looking in the direction of the arrows.
Figure 2A:
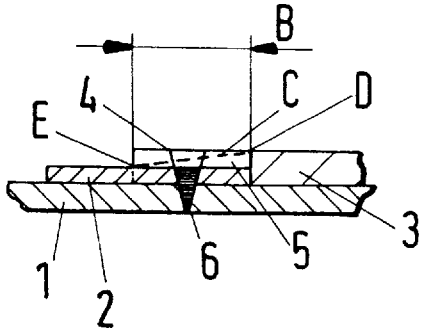
FIG. 2*a* is a fragmentary cross-sectional view at the location E of FIG. 1.

In the typical embodiment of the invention shown in FIGS. 1, 2 and 2*a*, a formed part is made of a base plate 1 and two reinforcing plates 2 and 3 which are mounted on the plate 1 and are made of a material such as steel having the same strength properties as the base plate. The thicknesses of the two reinforcing plates 2 and 3 are selected as a function of the load structure which will be applied to the formed part in use and may be different, as can be seen from FIG. 2. The two reinforcing plates 2 and 3 have saw tooth-like configurations at the edges which face each other, providing tooth-like projections 4 and 5 having straight flanks and being in interlocking mutual engagement. In this positive-locking and, in this case, at least partly overlapping, arrangement, the reinforcing plates 2 and 3 are fastened to the base plate by spot welds 6. As shown in FIGS. 2 and 2*a*, a zone B is formed by this mutual engagement of the projections 4 and 5. In this zone B, the average material thickness determines the average strength, in particular the average bending strength, of the formed part. In the illustrated example, this strength decreases continuously along the straight line C from the edge D to the edge E as seen in FIG. 2*a*. The effective difference between the material thicknesses of the reinforcing plates is halved in the center of zone B, i.e., in the plane A intersecting the base plate 1 at right angles. As a result of the effective change in the material thickness as shown by line C, and the change in strength associated therewith, a bending moment applied to the formed part in the zone B is transformed in accordance with the progression of line C from the edge D to the edge E in the loaded formed part.

Figure 3:
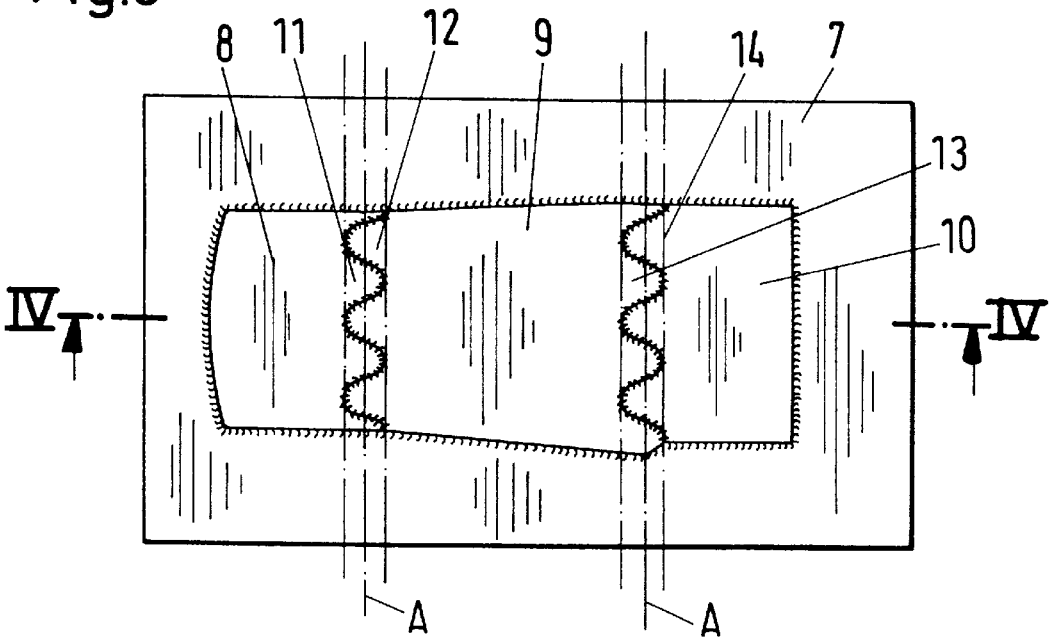
FIG. 3 is a plan view showing another representative embodiment of a formed part according to the invention.
Figure 4:
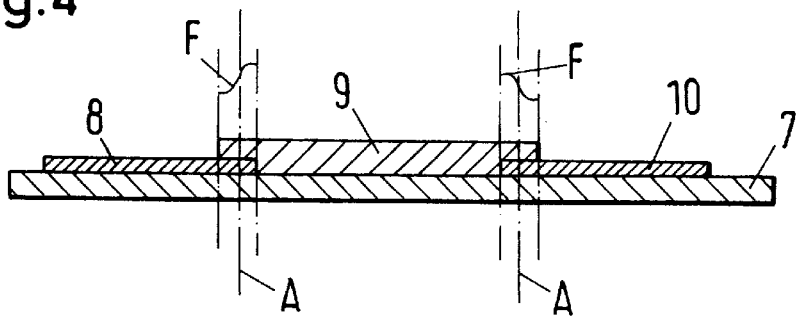
FIG. 4 is a cross-sectional view taken on the line IV—IV of FIG. 3 and looking in the direction of the arrows.

FIGS. 3 and 4 show another formed part in accordance with the invention having a base plate 7 and three reinforcing plates 8, 9 and 10 mounted on the base plate 7. The reinforcing plates are made of a material having the same strength properties but have different thickness according to the load structure to be applied to the formed part. The edges of the reinforcing plates 8, 9 and 10 which face each other have a wavelike profile, providing projections 11 and 12 and 13 and 14, respectively, with curved flanks which are in mutual engagement. In this arrangement, the shape of the projections 13 and 14 may be different from the shape of the projections 11 and 12. The reinforcing plates 8, 9 and 10 are connected to the base plate 7 by an uninterrupted laser weld along the contact lines and the outer margins of the reinforcing plates. In. FIG. 4, the change in the average thickness, and thus in the strength of the plate structure or of the formed part, in the direction between the reinforcing plates 8 and 9 and 9 and 10, respectively, is indicated by the curved lines F. In contrast to the exemplary embodiment according to FIGS. and 2, the lines F are not linear.

Figure 5:
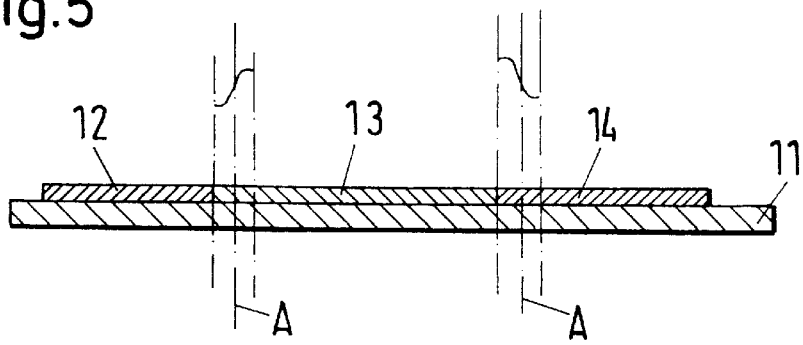
FIG. 5 is a cross-sectional view showing a further embodiment of a formed part according to the invention.

Finally, FIG. 5 shows another embodiment according to the invention consisting of a formed part in which three reinforcing plates 12, 13 and 14 having different strength properties are fastened to a base plate 11. The load structure of this formed part corresponds to that in the exemplary embodiment according to FIG. 4. In this case, the center reinforcing plate 13 has a higher material strength than the two other reinforcing plates 12 and 14, and the reinforcing plate 12 has a higher material strength than the reinforcing plate 14. The reinforcing plates 12 and 13 are consequently thinner than the reinforcing plates 8 and 9 according to FIG. 4 and have the same thickness as the adjacent reinforcing plate 14.

Although the invention has been described herein with reference to specific embodiments, many modifications and variations therein will readily occur to those skilled in the art. Accordingly, all such variations and modifications are included within the intended scope of the invention.

We claim:

1. A formed part having a multiple-plate structure of zonal design comprising:

a base plate; and a plurality of reinforcing plates fastened to the base plate;

wherein the reinforcing plates have projections which engage each other along abutting edges.

2. A formed part according to claim 1 wherein the abutting edges of adjacent reinforcing plates have projections which are in mutual engagement in an interlocking or overlapping manner.

3. A formed part according to claim 1 wherein the reinforcing plates are fastened at their margins to the base plate by welding with a high-energy beam.

4. A formed part according to claim 1 wherein the projections of the reinforcing plates are fastened to the base plate.

5. A formed part according to claim 1 wherein the projections have rounded flanks.

6. A formed part according to claim 1 wherein the projections have straight flanks.

7. A formed part according to claim 1 wherein the reinforcing plates are made of materials of different bending strengths.

8. A formed part according to claim 1 wherein the base plate and the reinforcing plates are provided with an anti-corrosive coating on surfaces facing each other.

* * * * *